US005440808A

United States Patent [19]

Wexler

[11] Patent Number: 5,440,808

[45] Date of Patent: Aug. 15, 1995

[54] DISPOSABLE SHAPED ARTICLE

[75] Inventor: Fred C. Wexler, Madison, Conn.

[73] Assignee: Warner-Lambert Company, Morris Plains, N.J.

[21] Appl. No.: 828,090

[22] Filed: Jan. 30, 1992

[51] Int. Cl.[6] ..... B26B 21/52

[52] U.S. Cl. ..... 30/85; 30/32; 30/345; 15/143.1

[58] Field of Search ..... 30/32, 41.7, 41.8, 85, 30/88, 89, 90, 345; 106/126, 130, 163.1, 205, 213, 222, 214; 264/230, 259; 428/35.6, 36.5, 36.91, 37.3, 68, 76; 47/74; 15/143.1; 16/110 R, DIG. 19

[56] References Cited

U.S. PATENT DOCUMENTS

| | | | |
|---|---|---|---|
| 1,955,460 | 4/1934 | Heppenstall, Jr. | 30/41.8 |
| 3,852,913 | 12/1974 | Clendinning et al. | 47/74 |
| 4,432,136 | 2/1984 | Taylor | 30/32 |
| 4,449,214 | 2/1985 | Sortwell | 106/205 |
| 4,600,439 | 7/1986 | Schneider | 106/214 |
| 4,615,924 | 10/1986 | Hekal et al. | 106/222 |
| 4,673,438 | 6/1987 | Wittwer et al. | 106/213 |
| 4,722,951 | 2/1988 | Yoshioka et al. | 106/163.1 |
| 4,735,660 | 4/1988 | Cane | 106/163.1 |
| 4,738,724 | 4/1988 | Wittwer et al. | 106/263 |
| 4,752,500 | 6/1988 | Simonson et al. | 106/163.1 |
| 4,795,509 | 1/1989 | DeBruycker | 264/230 |
| 4,863,655 | 9/1989 | Lacourse et al. | 106/213 |
| 5,029,390 | 7/1991 | Reeves | 30/40 |
| 5,035,930 | 7/1991 | Lacourse et al. | 106/213 |
| 5,054,154 | 10/1991 | Schiffer et al. | 15/167.1 |
| 5,211,669 | 5/1993 | Bonnes et al. | 16/110 R |
| 5,272,784 | 12/1993 | Levin | 15/143.1 |

FOREIGN PATENT DOCUMENTS

| | | | |
|---|---|---|---|
| 2842035 | 4/1980 | Germany | 16/110 R |

*Primary Examiner*—Richard K. Seidel
*Assistant Examiner*—Jay A. Stelacone
*Attorney, Agent, or Firm*—Charles W. Almer, III

[57] ABSTRACT

An article having a biodegradable inner core and a resistant outer coating has exposure means for exposing the inner core to the environment after completion of the useful life of the article.

27 Claims, 5 Drawing Sheets

FIG-1
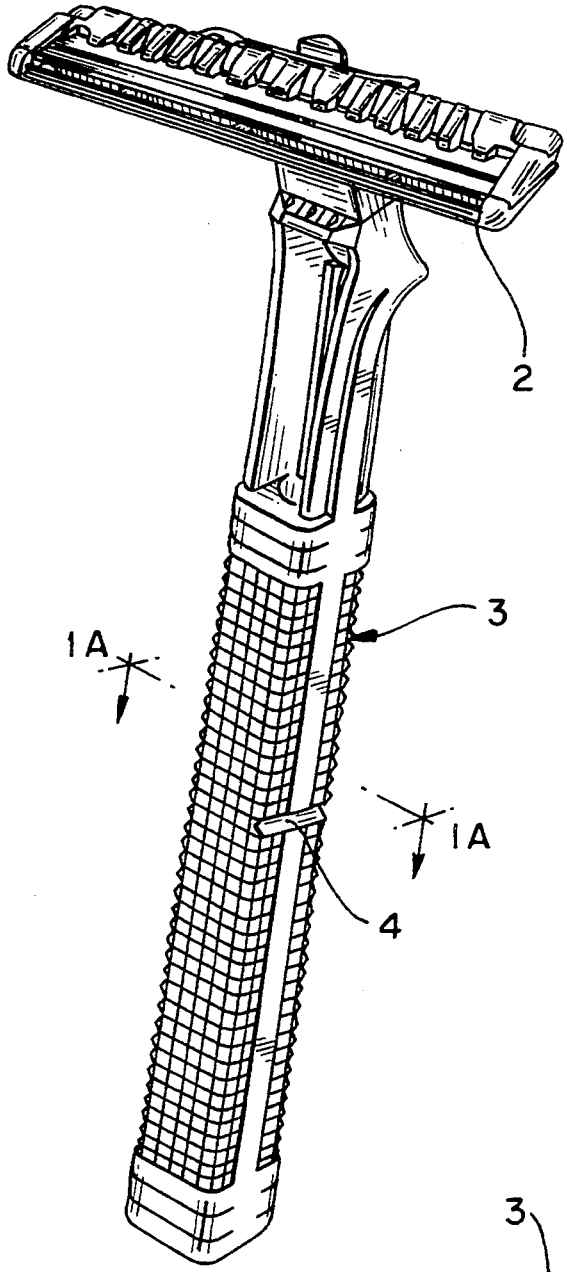
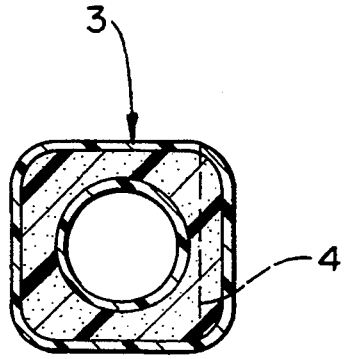
FIG-1A

DISPOSABLE SHAPED ARTICLE

BACKGROUND OF THE INVENTION a. Field of the Invention

The invention relates to coated, shaped articles prepared from a biodegradable material and to processes for making and using such articles.

b. Description of Related Art

It has long been known that disposable articles are filling up the solid waste facilities of this country. Plastic articles, in particular, pose a difficult disposal problem. Such articles usually require many years to decay in landfills, and such articles may remain in essentially unaltered form for generations.

One potential solution for reducing the amount of plastic solid waste is recycling. A plastic product may, if properly recycled, have several "lives" in different forms and shapes. While recycling provides a useful and desirable means of reducing the amount of solid waste generated, it does not solve the problem of final disposal of the plastic.

In our society disposability has become a way of life. Sizable segments of the consuming public use products that are geared to convenience and these consumers are often not motivated to take part in the recycling projects that can significantly affect our solid waste landfills. With respect to consumer products, such as disposable razors, attempts at interesting users in marketing programs designed to facilitate recycling have met with failure. Consumers are apparently not eager to take the extra time or expend the extra effort to make such programs work. It is an object of the present invention to provide a shaped article, such as, but not limited to, a disposable razor, in a form that is acceptable to the disposable product using public while simultaneously offering an easy, efficient method for consumers to activate the degradation process.

Another potential solution to the problem of disposal of plastic solid wastes is to make plastic articles out of "biodegradable" materials. Generally speaking, biodegradable materials are those that can readily be broken down into constituent elements that are either beneficial to, or are at least not adverse to, the biosphere. An example of such a "biodegradable" plastic is NOVON brand biodegradable polymer, a starch-based polymer described in U.S. Pat. No. 4,673,438 and U.S. Pat. No. 4,738,724, which are incorporated herein by reference. Shaped articles made from such a material can rapidly be broken down in landfills and can even provide nutrients for the soil in the landfill in the process.

One difficulty with biodegradable plastics such as NOVON brand biodegradable polymer is that such materials are not well suited for use in wet environments. The very factors that make biodegradable plastics such as NOVON brand biodegradable polymer easily biodegradable make them susceptible to degradation in a wet environment. Disposable shaving razors, for example, are exposed to water daily in use and may be fully immersed. Such immersion would quickly lead to degradation of a disposable razor made exclusively from NOVON.

Accordingly, it is an object of the present invention to provide a shaped article, such as a disposable razor, substantially made from a biodegradable material such as NOVON, that is substantially biodegradable yet is suitable for use in a wet environment.

SUMMARY OF THE INVENTION

The invention comprises a shaped article substantially comprising a biodegradable material. The article has an outer layer that resists degradation by hostile fluids and an activation means incorporated into the article or outer layer so that the biodegradable inner layer or core can be exposed to the environment.

The invention also comprises a process for preparing such a shaped article and a process for using such a shaped article.

Other features and advantages of the invention will be apparent from an examination of the following specification when read in conjunction with the appended drawings.

BRIEF DESCRIPTION OF THE DRAWINGS

FIG. 1 shows a side view of a disposable razor having a handle made in accordance with the invention containing V-notch activation means.

FIG. 1A shows a cross-section of FIG. 1 along the line 1A.

DESCRIPTION OF THE PREFERRED EMBODIMENTS

Figure 2:
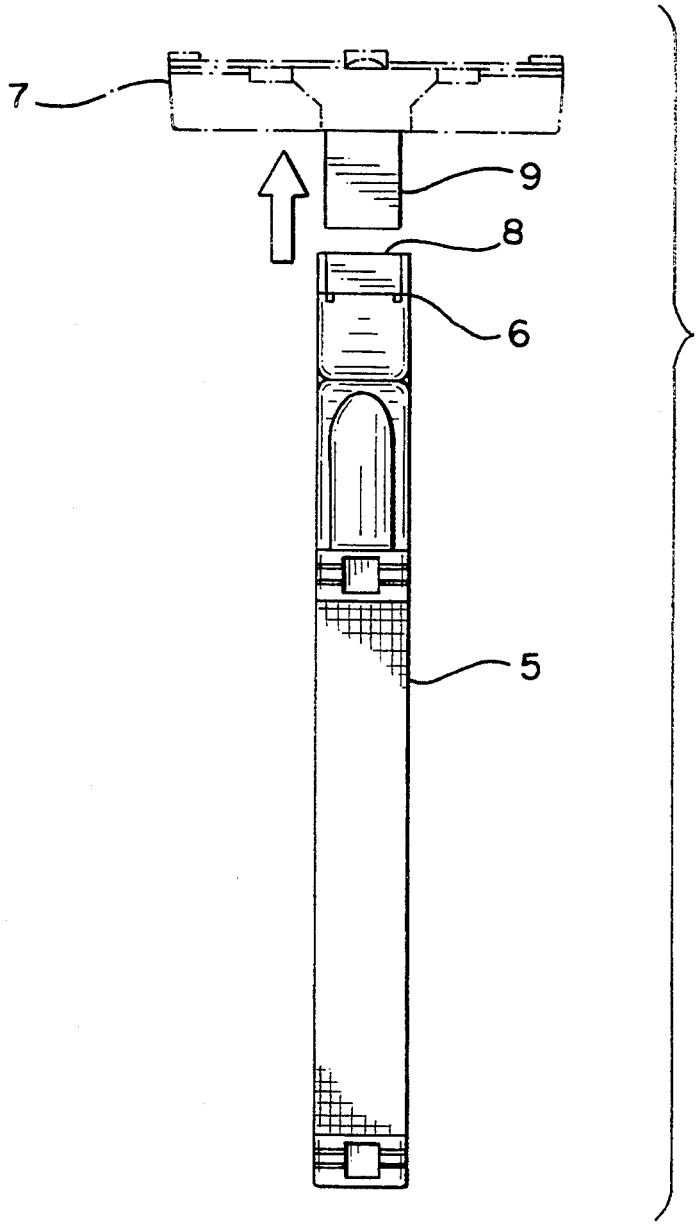
FIG. 2 shows an embodiment of the invention employing a press fit activation means.

The invention comprises an article for use in a hostile fluid environment, comprising an inner core of a formable biodegradable material and an outer coating of a material resistant to the hostile fluid environment covering the inner core. The article comprises exposure means for exposing the formable biodegradable material to at least one degradation agent.

As used herein, the term article refers to any object that is capable of being used for any purpose. Preferred articles, however, are those that are both disposable and subject to being used in a wet environment. More preferred are personal use items such as containers for personal products like shampoo, deodorant and other products that need to withstand moisture in ordinary use. Most preferred are articles such as disposable razors and toothbrushes that are exposed to running water on at least a daily basis and are disposed of after multiple uses. While items that are disposed of after a single use are not excluded from the scope of the invention, the extra process steps set forth below might make such single use items less preferable from an economic point of view.

The articles comprise an inner core of a formable biodegradable material. Preferred are thermoplastic, biodegradable materials. Especially preferred is NOVON brand biodegradable polymer, a material described in U.S. Pat. No. 4,673,438 and U.S. Pat. No. 4,738,724, which are incorporated herein by reference. This material is very biodegradable, but it is susceptible in its pure form to degradation in a wet environment.

The inner core may also comprise blends of a thermoplastic biodegradable material and at least one other thermoplastic or non-thermoplastic material. This additional material may be biodegradable or not, depending on the structural and durability needs of the particular article. If the core comprises nonbiodegradable material, however, the overall composition may be less biodegradable and more solid waste will remain in a landfill for a longer time. Preferably the percentage of biodegradable material in the inner core comprises from about 25% to about 99.9%.

The term "hostile environment" encompasses all environments that comprise elements which might degrade the material in the inner core during the useful life of the article, in the absence of the outer coating. Typical environments include wet environments, i.e., those that are fully or partially exposed to moisture or high humidity. Additional types of wet environments are those containing organic solvents. Articles such as disposable shaving razors and toothbrushes are exposed to both high humidity and moisture during the course of use and storage so that the biodegradable thermoplastic material, if not protected, may be sufficiently degraded to affect the performance of the article in use.

The inner core and the outer coating are preferably in contact with each other. The article, however, may include one or more adhesion means for bonding the two materials together. Suitable adhesion means include an adhesive layer or other suitable bonding material between the inner core and the outer coating.

The outer coating can be any material that "resistant." As used herein, the term "resistant" means sufficiently resistant to degradation or penetration by agents in the hostile environment so that the inner core material is not affected by the hostile environment in which the article is placed during the usable life of the article. The outer material is preferably, but not necessarily, biodegradable, but less so than the inner core. If the outer coating is not biodegradable, then, the article will not be 100% biodegradable, but will still be largely biodegradable. If the outer coating is not biodegradable, then, preferably, the outer coating should be sufficiently thin, preferably not more than 25% of the thickness or diameter of the article, to minimize the amount of non-biodegradable material present in the article while still providing sufficient protection to the inner core. More preferably, the non-biodegradable material comprises as little as 0.1% of the thickness or diameter of the article. Polyurethane is an example of a non-biodegradable outer coating material, which may be sprayed onto a NOVON inner core. In the alternative, a NOVON brand biodegradable polymer inner core may be dipped into a reservoir of liquid polyurethane. Other techniques for achieving the desired coating or outer layer include, but are not limited to, painting, dripping, co-molding, co-extruding and shrink wrapping.

The term "biodegradable," as used herein, means subject to chemical degradation, usually oxidation, by exposure to biological and environmental conditions. The term includes degradation by exposure to ultraviolet light, sunlight, temperatures and pressures normally found in landfills, bacteria (both aerobic and anaerobic) and any other condition found in the biosphere. The time required for degradation is not, however, fixed. Preferably, degradation takes place quickly after exposure to environmental conditions in a landfill, but even if degradation takes more than a trivial amount of time, the material can still be considered "biodegradable."

The outer coating and, optionally, the inner core, comprise exposure means for exposing the inner core to degradation after use. Preferably such exposure means comprise scoring or a designed weak point in the article or coating so that the article or coating can be broken by the user during disposal of the article. The force required to activate the exposure means should be greater than that encountered during normal use of the article. More preferably the access means comprises scoring or at least one notch placed in the article to allow the user to break the article after use to expose the biodegradable core. After exposure, the inner core erodes away, optionally leaving a residue of coating material.

The invention will be better understood by viewing the accompanying drawings. FIG. 1 shows a disposable razor. The razor comprises two parts, a razor head 2 and a handle 3. The head comprises a material sufficiently resistant to a hostile environment, in this case a wet environment, to maintain the razor blades in fixed relationship for shaving. The handle comprises an inner core of biodegradable material such as NOVON brand biodegradable polymer and an outer coating of a resistant material such as polyurethane. In alternative embodiments the inner core could contain one or more additional materials each of which may or may not be biodegradable or thermoplastic. Examples of such alternative materials would be wood and paper derivatives. The handle shown in FIG. 1 may be hollow, in which case the outer coating would also coat the inner surface of the handle.

An exposure means is shown in FIG. 1. An indentation 4 is incorporated into the handle that allows the handle to break either by manual pressure exerted on the indentation by the user when the useful life of the product is finished or by mechanical action after disposal, i.e., by a trash compactor or by forces exerted during disposal process.

This breakage exposes the biodegradable interior of the handle and allows degradation of the inner core in short order.

FIG. 2 shows an alternative embodiment employing a press fit activation means. A handle 5, with a top portion 6 is connected to the razor head 7 at 8, through a bottom portion 9 on razor head 7. The top portion 6 and the bottom portion 9 are of diameters whereby upon insertion of one into the other the connection is such that the force required to separate them exceeds the force likely to be seen in the normal use of the article but is within the range of forces that could be exerted by a consumer desiring to separate the top and bottom portions 6 and 9 to expose the inner core of biodegradable material.

Figure 3:
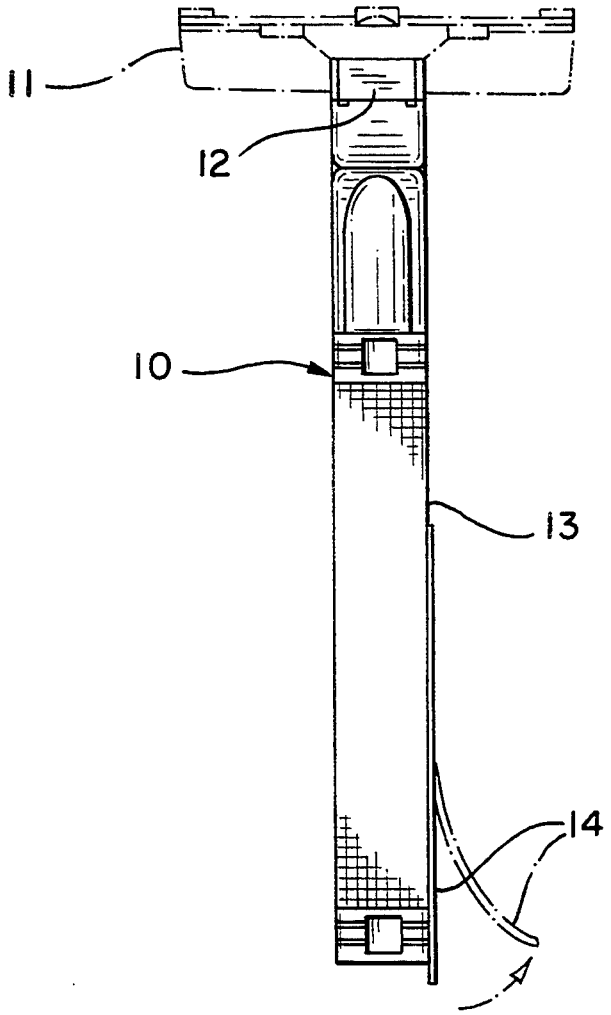
FIG. 3 shows an embodiment of the invention employing a peelable tab activation means.

FIG. 3 shows an alternative embodiment employing a peelable tab activation means. A handle 10 is connected to a razor head 11 at 12. The handle 10 has incorporated on its surface 13 a peelable tab 14. The peelable tab 14 is adhered to the handle 10 such that the force required to strip the peelable tab 13 from the surface of the handle 10 exceeds the force likely to be seen in the normal use of the article but is within the range of forces that could be exerted by a consumer desiring to separate the peelable tab 14 from the handle 10 to expose the inner core of biodegradable material.

Figure 4:
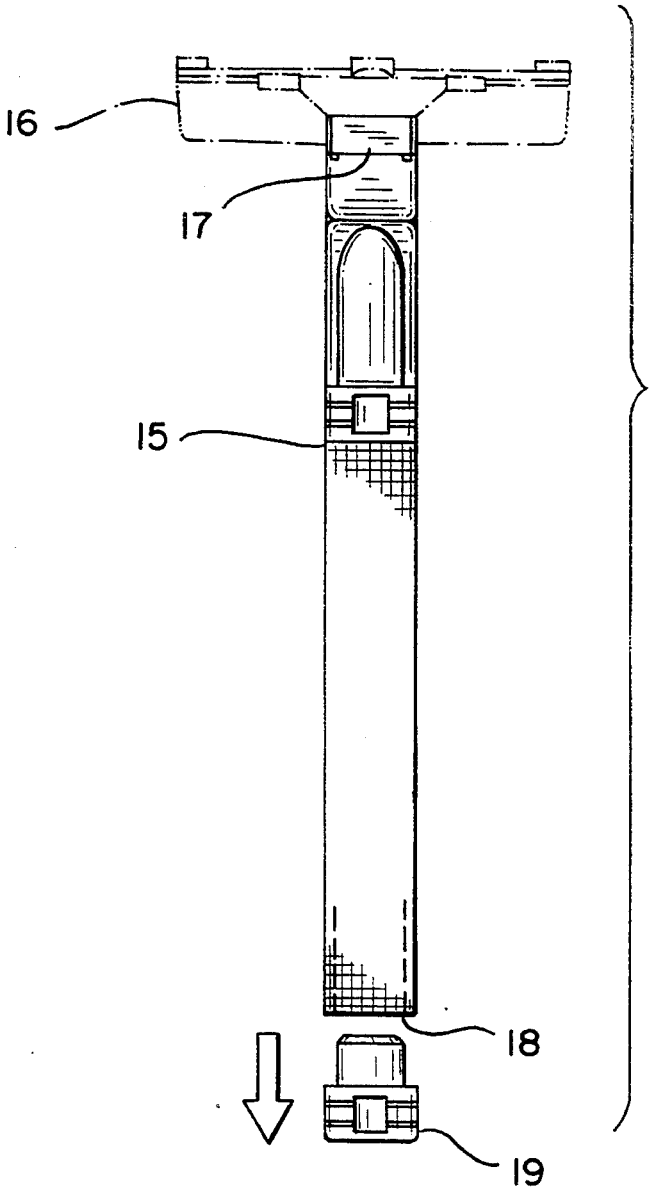
FIG. 4 shows an embodiment of the invention employing an end plug activation means.

FIG. 4 shows an alternative embodiment employing an end plug activation means. A handle 15 is connected to a razor head 16 at 17. The handle 15 has, at the end opposite to the razor head 18, an end plug 19. The end plug 19 is connected to the handle 15 by a press fit connection joint.

Figure 5:
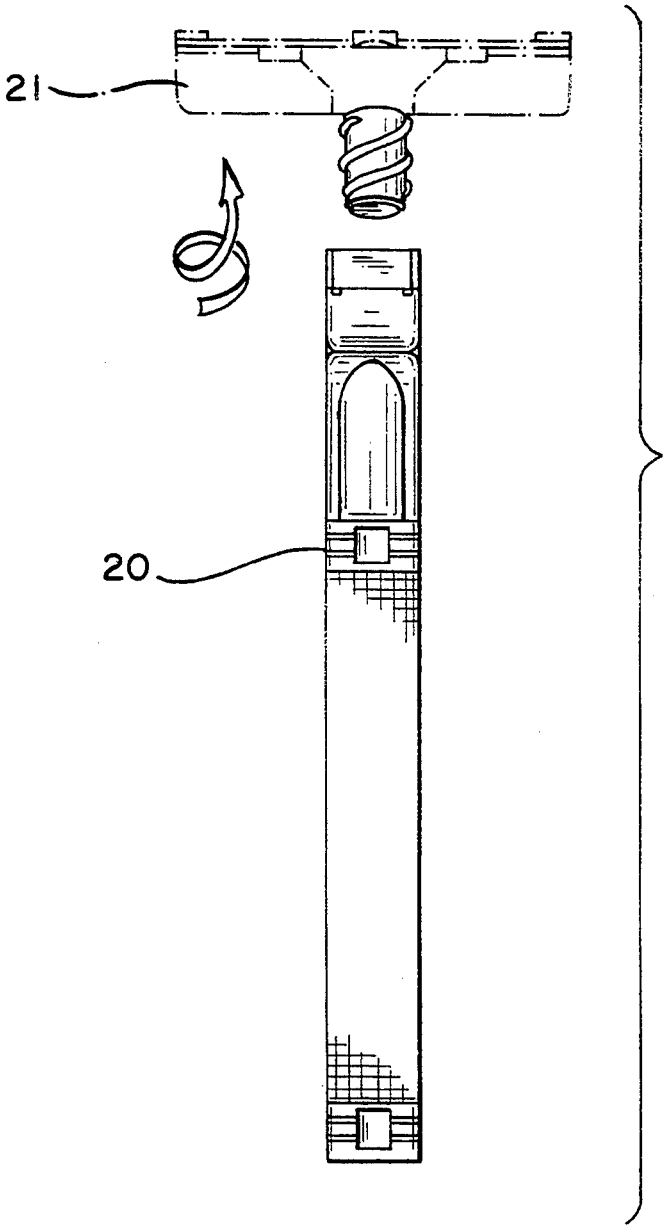
FIG. 5 shows an embodiment of the invention employing a screw activation means.

FIG. 5 shows an alternative embodiment employing a screw thread activation means between a closed end handle 20 and a razor head 21 such that the handle 20 can be unscrewed to expose the inner core of biodegradable material.

It will be apparent to those skilled in the art that various modifications and alterations may be made in the invention without departing from the scope or spirit thereof.

What is claimed is:

1. An article for use in a hostile fluid environment, comprising:

(a) an inner core comprising a thermoplastic material derived from starch;

(b) an outer coating of a material resistant to said hostile fluid environment covering said inner core; and (c) exposure means for exposing said thermoplastic material to at least one degradation agent.

2. The article of claim 1, wherein the hostile fluid environment is an aqueous environment.

3. The article of claim 1, wherein said inner core comprises at least one additional material, and wherein at least one of said additional inner core materials comprises a non-thermoplastic, biodegradable material, and wherein said non-thermoplastic, biodegradable material comprises a material derived from wood or paper.

4. The article of claim 1, wherein said inner core comprises a material derived from wood.

5. The article of claim 1, wherein said hostile liquid environment is an organic environment.

6. The article of claim 1, wherein said inner core comprises at least one additional material, and wherein at least one of said additional materials comprises a non-biodegradable material.

7. The article of claim 1, wherein said outer coating comprises a thermoplastic material.

8. The article of claim 1, wherein said outer coating is selected from the group consisting of polyurethane, shellac and lacquer.

9. The article of claim 1, further comprising an adhesion means for joining said outer coating and said inner core.

10. The article of claim 1, wherein said outer coating is applied to said inner core by a process selected from the group consisting of co-molding, co-extrusion, spraying, painting, dipping, shrink wrapping and dripping.

11. The article of claim 1, wherein said exposure means is selected from the group consisting of a press fit connection or a screw connection between segments of said article, a peelable tab on at least one surface of said article, or a removable end plug of said article.

12. The article of claim 1, wherein said exposure means comprises a fault in said article.

13. The article of claim 12, wherein said fault comprises a V-notch or groove.

14. The article of claim 13, wherein said groove is circular.

15. The article of claim 13, wherein said groove is on at least one surface of said article.

16. The article of claim 1, wherein said article comprises a toothbrush.

17. The article of claim 1, wherein said inner core comprises at least one additional material, and wherein the percentage of biodegradable material in said inner core is between about 25% and about 99.9% by weight.

18. The article of claim 1, wherein, said outer coating of resistant material comprises no more than 25% of the diameter of said article.

19. A disposable razor comprising:

(a) an inner core of a formable biodegradable material;

(b) an outer coating of a material resistant to moisture covering said inner core; and (c) exposure means for exposing said formable biodegradable material to at least one degradation agent.

20. The razor of claim 19, wherein said inner core comprises a thermoplastic material derived from starch.

21. The razor of claim 20, wherein said inner core further comprises at least one additional material.

22. The razor of claim 19, wherein said inner core comprises a material derived from wood.

23. The razor of claim 19, wherein said outer coating comprises a thermoplastic material.

24. The razor of claim 19, further comprising an adhesion means for joining said outer coating and said inner core.

25. The razor of claim 19, wherein said exposure means is selected from the group consisting of a press fit connection between segments of said razor, a screw connection between segments of said razor, a peelable tab on at least one surface of said razor, or a removable end plug of said razor.

26. The razor of claim 19, wherein said exposure means comprises a fault in said razor.

27. The razor of claim 26, wherein said fault comprises a V-notch or groove in said razor.

* * * * *